US012280973B2

(12) United States Patent
Austin et al.

(10) Patent No.: US 12,280,973 B2
(45) **Date of Patent: *Apr. 22, 2025**

(54) METHOD AND APPARATUS FOR A TRANSFER TAPE APPLIED TO FORM A RAISED PROFILE

(71) Applicant: Papeltec Overseas, Inc., Atlantic Beach, FL (US)

(72) Inventors: Craig Austin, Jacksonville, FL (US); Peter Rodriguez, Jacksonville, FL (US); Jason Rodriguez, Jacksonville, FL (US)

(73) Assignee: Papeltec Overseas, Inc., Atlantic Beach, FL (US)

( * ) Notice: Subject to any disclaimer, the term of this patent is extended or adjusted under 35 U.S.C. 154(b) by 399 days.

This patent is subject to a terminal disclaimer.

(21) Appl. No.: 17/827,699

(22) Filed: May 28, 2022

(65) Prior Publication Data

US 2022/0380158 A1 Dec. 1, 2022

Related U.S. Application Data

(60) Provisional application No. 63/194,280, filed on May 28, 2021.

(51) Int. Cl.

| | |
|---|---|
| ***B65H 19/29*** | (2006.01) |
| ***B65H 19/26*** | (2006.01) |
| ***B65H 19/28*** | (2006.01) |

(52) U.S. Cl.

CPC ..... *B65H 19/283* (2013.01); *B65H 19/267* (2013.01); *B65H 19/29* (2013.01); *B65H 2301/414422* (2013.01); *B65H 2301/41766* (2013.01); *B65H 2701/377* (2013.01); *B65H 2801/84* (2013.01); *Y10T 428/1476* (2015.01)

(58) Field of Classification Search

CPC .... B65H 19/29; B65H 19/267; B65H 19/283; B65H 2301/41766

See application file for complete search history.

(56) References Cited

U.S. PATENT DOCUMENTS

| | | | |
|---|---|---|---|
| 2,461,246 | A | 2/1949 | Weyenberg |
| 4,659,029 | A | 4/1987 | Rodriguez |
| 4,757,950 | A | 7/1988 | Rodriguez |
| 4,783,018 | A | 11/1988 | Rodriguez |
| 5,046,675 | A | 9/1991 | Rodriguez |
| 5,417,383 | A | 5/1995 | Rodriguez et al. |
| 5,453,141 | A | 9/1995 | Rodriguez |
| 5,637,170 | A | 6/1997 | Rodriguez |

(Continued)

*Primary Examiner* — Sang K Kim

(74) *Attorney, Agent, or Firm* — Tracnik Law PLLC; Joseph P. Kincart

(57) ABSTRACT

Methods and apparatus to form elevated profiles in mounted turn-up transfer tapes for paper processing. In some embodiments, the transfer tape may be a combination of a tape substrate coated on one side with a web grabbing adhesive and on the other side with a mounting adhesive and an affixed cord or cordlike feature, and a release liner having a release liner substrate fully coated on a first side with a release layer and zone-coated on a second side with a release layer. In some embodiments an elevated profile, similar to that resulting from the incorporated cord or cordlike feature, may be formed during the application of the transfer tape with specialized apparatus.

20 Claims, 10 Drawing Sheets

(56) References Cited

U.S. PATENT DOCUMENTS

| | | | | |
|---|---|---|---|---|
| 5,954,290 | A | 9/1999 | Rodriguez et al. | |
| 6,467,719 | B1 | 10/2002 | Rodriguez | |
| 6,578,788 | B2 | 6/2003 | Rodriguez et al. | |
| 7,875,152 | B2 | 1/2011 | Rodriguez | |
| 8,124,209 | B2 | 2/2012 | Rodriguez | |
| 8,178,181 | B2 | 5/2012 | Rodriguez | |
| 8,580,062 | B2 | 11/2013 | Rodriguez | |
| 2022/0315369 | A1* | 10/2022 | Rodriguez | B65H 19/267 |

* cited by examiner

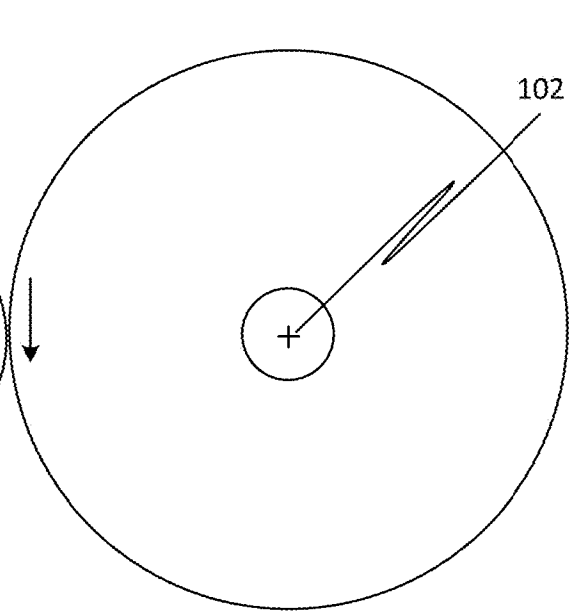
FIG. 1
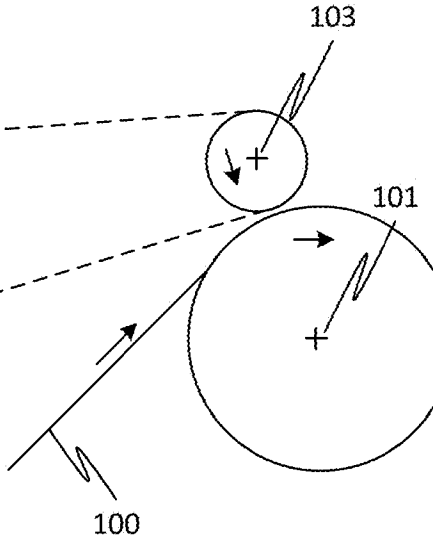
FIG. 1A
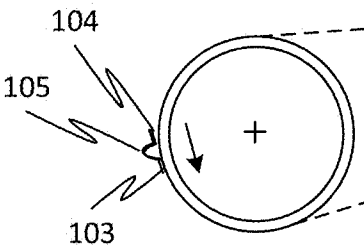

METHOD AND APPARATUS FOR A TRANSFER TAPE APPLIED TO FORM A RAISED PROFILE

RELATED APPLICATIONS

This application claims the benefit of U.S. Provisional Patent Application Ser. No. 63/194,280, entitled "METHOD AND APPARATUS FOR A TRANSFER TAPE APPLIED TO FORM A RAISED PROFILE" filed May 28, 2021, the contents of which are relied upon an incorporated herein by reference in their entirety.

FIELD OF THE INVENTION

This invention relates generally in a first sense to the field of devices, apparatus and methods of effecting the high-speed severing and transfer of a rapidly advancing paper web from a rotating full web spool onto an empty web spool, and more particularly where such an operation is performed utilizing a transfer or double-sided adhesive turn-up tape. More particularly, the invention relates to an apparatus and method for dispensing transfer tape and its use in a paper web severing/transfer method, wherein the transfer tape is the affecting means for severing, transferring and securing the paper web from a rotating full web spool onto an empty web spool. Additionally, the invention relates in general to methods and apparatus to apply transfer tapes to form cavity structures and raised portions of the transfer tape.

BACKGROUND OF THE INVENTION

Modern paper manufacturing is typically performed by producing continuous lengths of paper having widths of over 400 inches in some cases, referred to as paper webs, which are wound onto web spools for subsequent converting, storage, transfer or the like. The winding or spooling operation for the paper web, such as in the case of tissue grades, occurs at high speeds, in some cases exceeding 6000 feet per minute, and in order to maximize production by minimizing downtime and waste it is desirable to sever and simultaneously transfer the moving paper web from a full web spool onto an empty web spool without stopping, adjusting draws (i.e. the speed differential between the incoming and outgoing web rotating support members that are not driven by a common source) or slowing the movement of the web.

SUMMARY OF THE INVENTION

Accordingly, it is an object of this invention to provide apparatus and methods to elevate portions of attached transfer tapes above the portion of a spool that they are attached to. By elevating portions of the attached transfer tape, the elevated portion may increase the profile of the transfer tape to fill an open nip. There may also be the benefit of concentrating the forces involved in crushing the cord such that the energy serves to augment the severing of the web.

In some embodiments, portions of the transfer tape may be elevated by utilizing designs of the transfer tape comprising a cord or filament that is included into the structure of the transfer tape and provides support and stiffening of the transfer tape. In some preferred embodiments, the transfer tape may include a cord that contains material suitable to be re-pulped and included in the paper product. The suitability to be re-pulped may significantly reduce waste in paper processing. In some preferred embodiments, the cord may consist entirely of material suitable to be repulped.

Alternatively, the invention may be summarized and described as a method of dispensing and applying a transfer tape with an incorporated cord feature onto an empty web spool to sever and secure a paper web from a first web spool onto an empty web spool in a web turn-up operation comprising the steps of: winding said transfer tape onto a transfer tape spool within a dispenser cartridge housing and extending said transfer tape through a slot in said housing a slot adapted such that said transfer tape passes through said slot; said transfer tape comprising a tape substrate coated on one side with a web grabbing pressure sensitive adhesive and on the other side with a mounting pressure sensitive adhesive, and a release liner having a release liner substrate fully coated on a first side with a release layer and zone-coated on a second side with a release layer, said release layer being of a material that prevents adhesion of the pressure sensitive adhesive to the release liner substrate; said zone-coated release layer defining a longitudinally extending uncoated joining region on a longitudinal edge of said release liner substrate, whereby said web grabbing adhesive adheres to the said uncoated joining region of said release liner substrate such that said zone-coated release layer defines a cover flap not adhered to said web grabbing pressure sensitive adhesive; wherein said step of winding said transfer tape onto said transfer tape spool includes winding said transfer tape onto said transfer tape spool with said release liner facing inward and said mounting side pressure sensitive adhesive facing outward, such that said release layer fully coated on said first side of said release liner substrate prevents adhesion of said mounting side pressure sensitive adhesive to said release liner substrate. Furthermore, the method further comprising the step of passing a segment of said transfer tape through said slot and applying said transfer tape to said empty web spool, pressing said transfer tape onto said empty web spool using a wiper, and cutting said segment of transfer tape; and/or wherein said step of applying said transfer tape to said empty web spool includes orienting said transfer tape on said empty web spool such that said cover flap extends in the direction of rotation of said empty web spool.

Alternatively, a transfer tape may be formed by assembling a tape substrate coated on one side with a web grabbing adhesive and on the other side with a mounting adhesive and a release liner having a release liner substrate fully coated on a first side with a release layer and zone-coated on a second side with a release layer, said release layer being of a material that prevents adhesion of the adhesive to the release liner substrate, and a cord affixed to the tape substrate. In some embodiments, the cord may be adhered to the mounting adhesive. In other examples, the cord may be adhered, potentially with a pressure sensitive coating, to the web grabbing adhesive. In some embodiments, the zone-coated release layer may define a longitudinally extending uncoated joining region on said release liner substrate. The web grabbing adhesive may adhere to the said uncoated joining region of the release liner substrate such that said zone-coated release layer defines a cover flap not adhered to the web grabbing adhesive. In some embodiments, the cord may define an elevated surface profile of the transfer tape proximate to the cord when the transfer tape is adhered to a surface.

Alternatively, a transfer tape may be formed by assembling a tape substrate coated on one side with a web grabbing adhesive and on the other side with a mounting adhesive and a release liner having a release liner substrate fully coated on a first side with a release layer and zone-coated on a second side with a release layer, said release layer being of a material that prevents adhesion of the adhesive to the release liner substrate. In some embodiments, this transfer tape without a cord may be applied upon the surface of a spool with an associated fixture that maintains the tape away from the surface of the spool in a center portion of the tape while allowing adhesive surface on the perimeter to interact with and adhere to the spool surface. The fixture may be formed with coatings that deter the adhesive from binding.

In other examples, the cord may be adhered, potentially with a pressure sensitive coating, to the web grabbing adhesive. In some embodiments, the zone-coated release layer may define a longitudinally extending uncoated joining region on said release liner substrate. The web grabbing adhesive may adhere to the said uncoated joining region of the release liner substrate such that said zone-coated release layer defines a cover flap not adhered to the web grabbing adhesive. In some embodiments, the cord may define an elevated surface profile of the transfer tape proximate to the cord when the transfer tape is adhered to a surface. The elevation of the surface profile may improve the efficacy of adherence to the paper web as the elevated surface profile helps to fill an open nip. In addition to aiding the adherence of the adhesive to the paper web, the novelty of the inventive examples herein may also improve the effectiveness of rupturing the paperweb as it severs from the Parent Web Spool. The added height of the transfer tape concentrate large forces as the spool approaches the Nip and the forces crush the cord. The added energy of the interaction may augment the severing of the web.

Methods and apparatuses for accomplishing severing and transfer utilizing what is known as a transfer or turn-up tape have been described. An early example of such a system is shown in U.S. Pat. No. 2,461,246 to Weyenberg. Other examples are shown in U.S. Pat. Nos. 4,659,029, 4,757,950, 4,783,018, 5,046,675, 5,453,141, 5,637,170, and 5,954,290.

Further examples and detailed discussion of such equipment, systems and methodologies are present in U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures, in their entirety, of which are incorporated herein by reference.

BRIEF DESCRIPTION OF THE DRAWINGS

With reference to the drawings, which are provided for descriptive and illustrative purposes are which are not meant to be limiting as the scope of the invention, the invention in various embodiments in a broad and general sense is an apparatus and a method for dispensing a multi-layer adhesive tape, and in particular a transfer tape used in a paper web turn-up operation.

FIG. 1 is an illustration of a paper processing system with an Empty Web Spool set up for paper web transfer.

FIG. 1A illustrates an enlarged view of an exemplary Cover Flap transfer paper construct for Turn-Up.

DETAILED DESCRIPTION OF THE INVENTION

Figures 2, 2A:
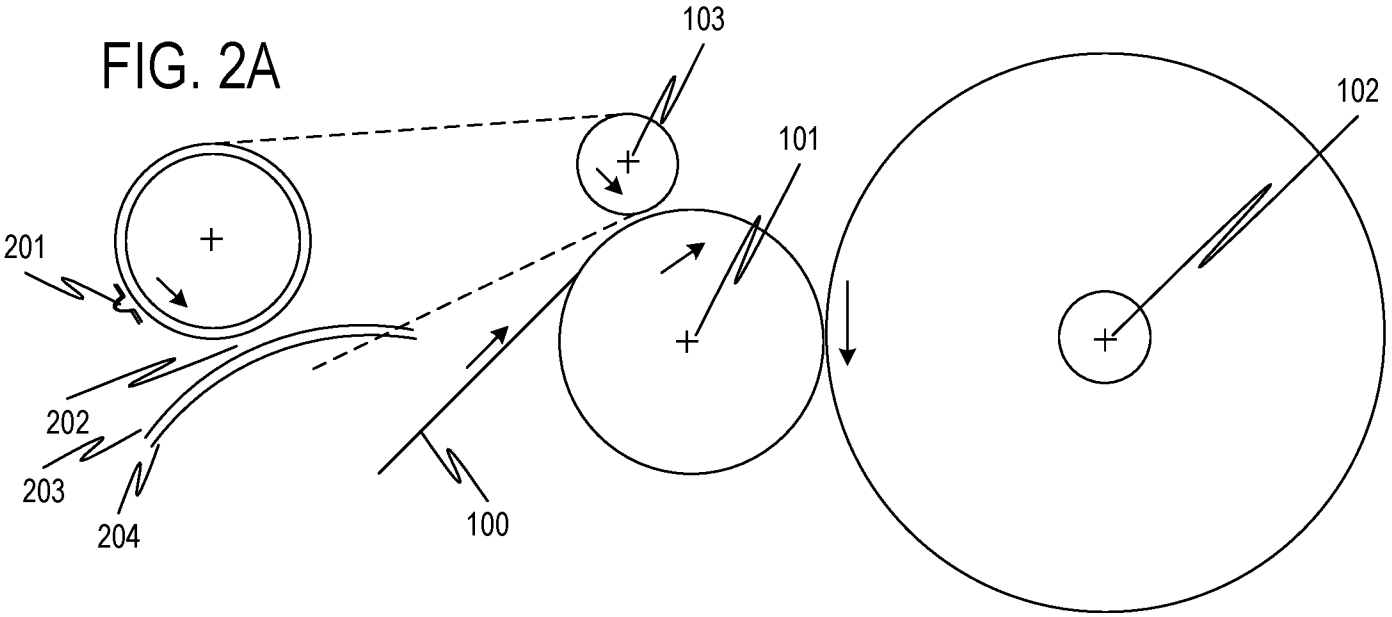
FIG. 2 illustrates a paper processing system with a Cover Flap transfer paper construct approaching a Nip.
FIG. 2A illustrates an enlarged view of an exemplary Cover Flap transfer paper construct as it approaches a Nip.

The present invention provides a transfer tape useful for severing and transferring a paper web, the transfer tape includes a substrate with a first adhesive side, the spool mounting side, preferably included of a pressure sensitive adhesive (pressure sensitive adhesive), adapted to contact and adhere to the longitudinal cylindrical surface of the empty web spool. The opposite side of the transfer tape substrate, the web-side (or web grabbing side), has a second adhesive side adapted to contact and adhere to the moving paper web when the rotating empty web spool is brought into contact with the paper web. With the adhesion of the paper web to the empty web spool through this transfer tape, the web is severed from the full web spool and its new leading edge, formed at the severing line created by the transfer tape, adheres to the rotating empty web spool, thus completing the transfer.

Some embodiments of the present invention include a transfer tape with a cover flap extending over the web-side adhesive on the substrate of the transfer tape, the cover flap being longitudinally adhered along one edge of the transfer tape, wherein the cover flap is provided with a release coating, such as a silicone layer, over the majority of the side of the cover flap facing the adhesive side. With such a construction, the cover flap may remain closed to protect the web-side adhesive from contaminants such as dust and debris until the empty web spool is spun up to its speed to match the speed of the web. As the empty web spool rotates the cover flap peels back due to aerodynamic effects, pulling the release-coated section of the flap away from the adhesive. The cover flap opens at its leading edge, which is the edge of the transfer tape first encountering the resulting airstream due to the rotation of the empty web spool. The cover flap remains attached to the web-side adhesive at the trailing edge of the transfer tape due to the flap being void of the silicone release layer in that narrow region. The transfer tape is now in a state with its protective cover flap peeled back to expose the fresh and uncontaminated adhesive and is able to adhere to the subject paper web to sever and transfer it to the empty web spool. Examples of such transfer tapes are shown in U.S. Pat. Nos. 8,124,209 and 8,178,181.

In some embodiments, the effectiveness of the transfer process may be limited because the interaction with of the paper tape with the paper web may not be optimal. It may be advantageous to elevate at least a portion of an adhesive coated portion of the paper tape above the web spool.

In some embodiments, the transfer tape may be mounted with an elevated portion, where the elevated portion is related either to a profile induced by an included cord of the transfer tape or to the manner of mounting the transfer tape with apparatus that form an uplifted profile as the tape is applied. By elevating portions of the attached transfer tape, the elevated portion may increase the profile of the transfer tape to fill an open nip. There may also be the benefit of concentrating the forces involved in crushing the cord such that the energy serves to augment the severing of the web.

Embodiments of the present disclosure may include a method for performing a turn up process on a paper making machine, the process including the steps of mounting a proximal end of a transfer tape construct at a first position on an empty web spool, the transfer tape construct including folded layers of adhesive, release coating, and pulpable substrate with a raised profile portion forming a peak with the pulpable substrate and layer of adhesive. The raised profile may include the pulpable substrate and layer of adhesive, bridging a gap between the empty web spool and a surface of a paper web rotating on a full web spool. Embodiments may also include adhering the adhesive layer to the paper web. Embodiments may also include continuing to spin the empty web spool and the transfer tape construct until the paper web severs via separation of fibers included in the paper web.

In some embodiments, the method may additionally include the step of continuing to spin the empty web spool and the transfer tape construct following the adhering of the adhesive layer to the paper web and the paper web severs, to form a roll of paper web on the empty web spool. In some embodiments, the method additionally may include the step of attaching the distal end of the transfer tape construct to a second position of the empty web spool.

In some embodiments, the method may still further include the step of protecting at least a portion of the adhesive layer from air borne contaminates with the folded layers of adhesive, release coatings and pulpable substrate. In some embodiments, the air borne contaminants may include paper particles. In some embodiments, the method, additionally including the step of forming a peak including the pulpable substrate and adhesive layer by including a cord beneath the adhesive layer.

In some embodiments, the method, additionally including the step of contacting the paper web with the peak including the pulpable substrate and adhesive layer and formed over the cord and compressing the peak including the pulpable substrate and adhesive layer via as the empty spool approaches the paper web. The cord may also be crushed.

GLOSSARY

Turn-Up: As used herein, a process involving switching a paper web from a nearly completed parent web spool to an empty web spool. A Turn-up process may include severing a paper web from a rotating parent web roll nearing its capacity to hold paper, transferring the paper web to an empty web spool, and securing the paper web to the empty web spool.

Transfer Tape: As used herein a Transfer Tape, sometimes referred to as a turn-up tape, refers to a substrate adapted for extending across a longitudinal cylindrical surface of one or both of an empty web spool and a paper bearing web spool. The transfer tape may include multiple layers.

Web Binding Adhesive: as used herein a Web Binding Adhesive, sometimes referred to as Web Grabbing Adhesive, refers to an adhesive layer of a transfer tape that attaches the transfer tape to a paper web. During paper manufacture and/or processing, a paper web that is attached via web binding adhesive may be pulled to a spool that a transfer tape is adhered to.

Mounting adhesive: as used herein a Mounting Adhesive refers to an adhesive used to bind transfer tape constructs together and/or used to hold a transfer tape construct to a spool.

Pressure Sensitive Adhesive: as used herein a Pressure Sensitive Adhesive refers to a non-reactive adhesive which creates binding force when pressure is applied to attach the adhesive to a surface.

Nip: as used here Nip refers to the area where a paper web or sheet is pressed between two rolls/spools.

Parent Web Roll: as used herein a Parent Web Roll, which may be called an Old Spool, refers to a web spool that is substantially nearing its capacity for holding paper web.

Empty Web Spool: as used herein an Empty Web Spool, sometimes referred to as an Empty Reel, a New Spool or an Empty Spool, may include a reel that paper web being reeled onto a Parent Roll is transferred to. The surface of an Empty Web Spool is commonly used to adhere a transfer tape upon.

Reel Drum: as used herein a Reel Drum refers to a spool used to drive movement of a paper web; in some embodiments a reel Drum may impart rotational movement to a Parent Roll receiving a paper web in a reeling action.

The present invention provides improved methods of utilizing a Raised Profile Transfer Tape Construct to sever and transfer a continuous paper web from one spool to another spool, such as may be especially useful in transferring lightweight papers such as tissue or newsprint Empty Web Spool. The Raised Profile Transfer Tape Construct may be applied to an Empty Web Spool Nip in a closed position such that the Raised Profile is temporarily adhered in a portion of its surface and opens during the run up in the speed of the spool to which it is attached due both to aerodynamic forces and to centrifugal force. In examples of the present application, the construct is produced so that when the Raised Profile opens, adhesive layers open with the Raised Profile presenting adhesive off of the surface of the spool. Adhesive layers may be elevated to interact with the paper web.

In operation, the present invention provides for a transfer to occur without requiring a flow of the paper web to be altered or stopped. It is to be understood that disclosure of the apparatus and method in relation to a paper web turn-up operation is an exemplary disclosure not meant to be limiting, as the Raised Profile Transfer Tape Construct, methods of its manufacture, and associated applications and methods of application may be suitable for use in different configurations.

A Raised Profile Transfer Tape Construct may be produced by assembling layers of structural materials, such as paper, along with layers of adhesive material, such as double stick adhesive tapes. Coatings of various kinds may be applied to the surfaces of the layers to alter properties of the surface. A release layer may be performed by coating a portion of a surface, such as with a silicone coating, that renders the surface as less adherent to an adhesive that may be attached to it. In a non-limiting example, if a portion of a surface of a structural layer is coated with a release coating, then an attached adhesive layer will form a strong bond with the uncoated portion and a weaker bond with the coated portion such that when forces are applied the adhesive will separate from the coated surface and lift up.

Referring to FIG. 1, a step of a paper Turn-Up process utilizing the concepts of the present specification is illustrated. As illustrated a Raised Profile Transfer Tape Construct 105 has been arranged on an Empty Web Spool 103. The Empty Web Spool 103 may be used to take up the new paper web 100 as it is moved by the Reel Drum 101 in the direction as shown by the arrows. At the starting step, the Full Web Spool 102 is approaching its capacity to take up the paper web 100. In the inset figure, FIG. 1A an enlarged view of the Empty Web Spool 103 is illustrated. on the surface of the Empty Web Spool 103 is the Raised Profile Transfer Tape Construct 105 which is held to the Empty Web Spool 103 with an adhesive layer 104.

Referring now to FIG. 2, the Empty Web Spool 103 approaches a Nip 202 as it moves towards the reel drum 101. The paper web 100, is still wrapping to the Empty Web Spool 102. As displayed in FIG. 2A, the mounted Raised Profile Transfer Tape Construct 201 sits on the surface of the Empty Web Spool 103. As the Empty Web Spool approaches the Nip 202 it will contact the paper web 203 which is upon the reel drum surface 204 and be rotated as shown by the arrows. Rotation may be accomplished, for example, via an electric or air powered motor (not illustrated). In some examples, the motor described may bring the Empty Web Spool 103 up to speed prior to it approaching the spool and closing the Nip.

A rotary speed (rotations per minute) of the Empty Web Spool 103 may be such that a surface speed of the Empty Web Spool 103 equals that of the paper web and reel drum 101 surface. During the run up of that speed, the raised profile of the mounted Raised Profile Transfer Tape Construct 201 may lift as the spool rotational speed increases the centrifugal force on the mounted Raised Profile Transfer Tape Construct 201.

The rotation may bring the mounted Raised Profile Transfer Tape Construct 201 into the Nip 202 which will put pressure onto the exposed adhesive surface. In some examples, the Raised Profile adhesive will approach the paper web when the Empty Web Spool 103 is brought into close contact with the paper web on the reel drum and compresses the Raised Profile Transfer Tape Construct 201.

Figures 3, 3A:
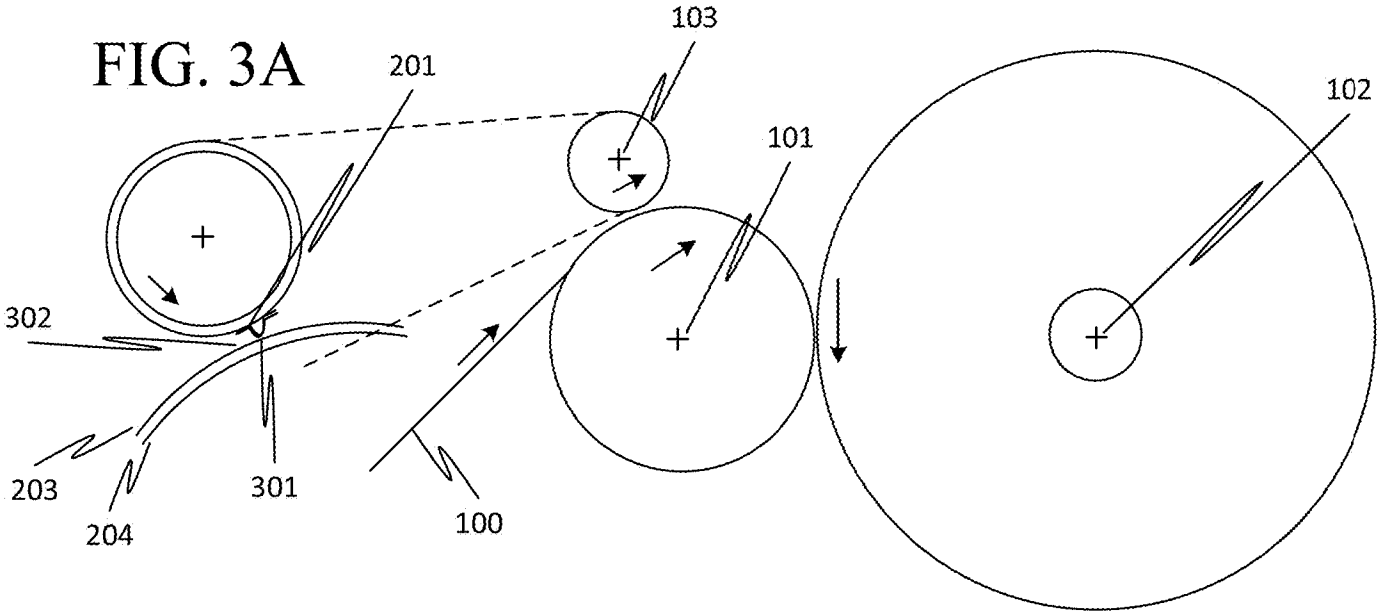
FIG. 3 illustrates a paper processing system where the Cover Flap transfer paper construct are compressed between an Empty Web Spool and a reel drum.
FIG. 3A illustrates an enlarged view of an exemplary Cover Flap transfer paper construct as it is compressed to release adhesive through the tissue paper.

In an example, proceeding now to FIGS. 3 and 3A, when the mounted Raised Profile Transfer Tape Construct 201 is in the Nip 302, the Raised Profile 301 of the mounted Raised Profile Transfer Tape Construct 201, may be pressed to adhere to the paper web 100 in the Nip 302. It may be noted that the proportions of the components in the figures may be exaggerated for the thickness or relative size to the spool and are illustrated for purposes of clarity.

Figures 4, 4A:
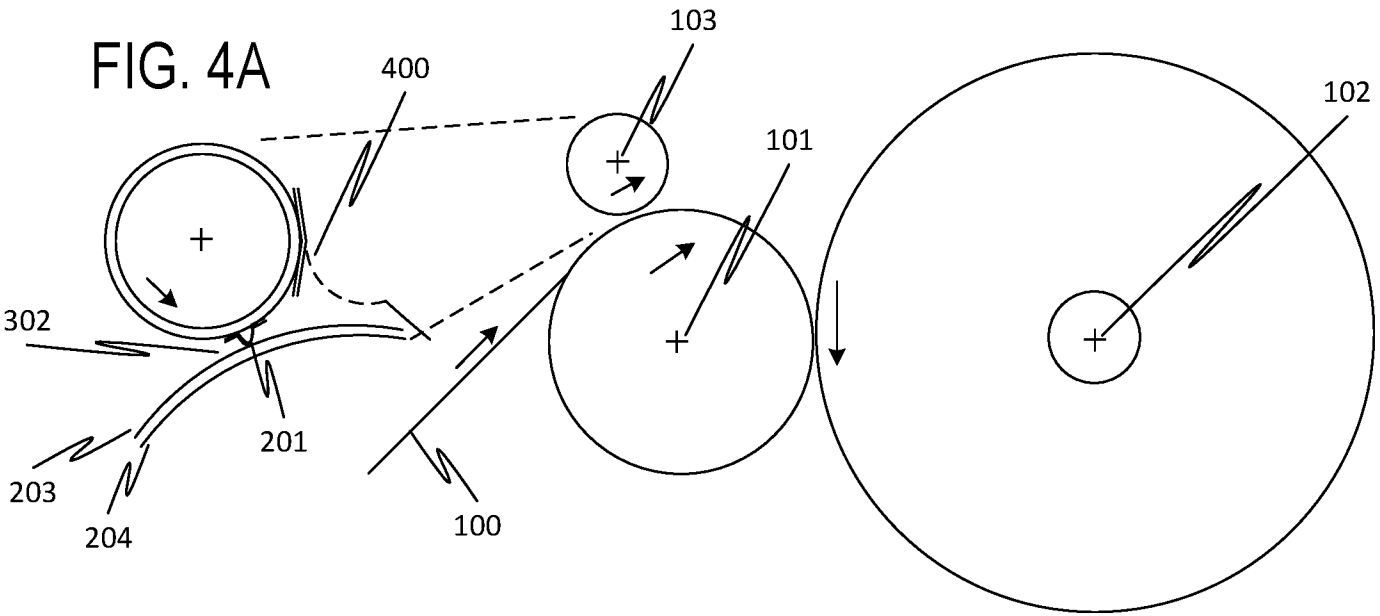
FIG. 4 illustrates a paper processing system where the Cover Flap of the Cover Flap transfer paper construct grabs the advancing paper web.
FIG. 4A illustrates an exploded view of an exemplary Cover Flap transfer paper construct as it grabs the advancing paper web.

Proceeding now to both FIGS. 4 and 4A, the adhesion of the paper web 400 as the reel drum 101 rotates and lifts the paper toward the Empty Web Spool 103. The Raised Profile Transfer Tape Construct 201 location is rotating out of the Nip 302 as new paper from the paper web 203 advances on the reel drum surface 204. As discussed, the illustrations are exemplary and are provided to illustrate fundamental aspects of various embodiments. The scales of the illustrations are not intended to be limiting, such as for example, the relative dimensions of an adhesive layer when compared to paper thickness and spool dimensions.

Figures 5, 5A:
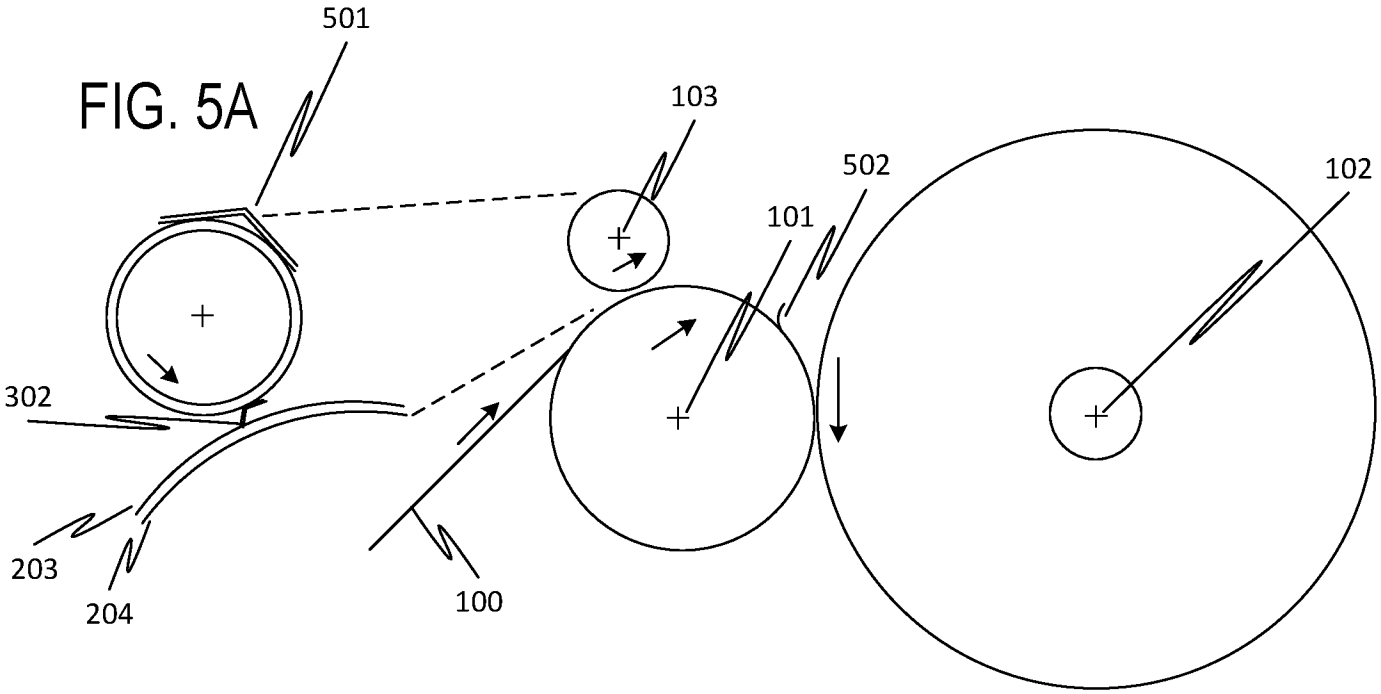
FIG. 5 illustrates a paper processing system where Turn-Up has occurred.
FIG. 5A illustrates an exploded view of an exemplary paper processing system where Turn-Up has occurred.

As illustrated in FIGS. 5 and 5A, as the Empty Web Spool continues to advance with the paper web attached to the adhesive it may eventually tear or burst the paper web 501 away from the last portion 502 of the paper web that is rolling onto the Parent Web Spool. This completes the turnup process. The Empty Web Spool 102 may be moved out of the region of the reel drum 101. As the Empty Web Spool 102 is moved out of the region the Empty Web Spool 102 may continue to pick up paper from the paper web 100 and be moved into the location that the Parent Web Spool had occupied before it was moved.

In some embodiments, the transfer tape may further include features formed by cord or cord like elements. A cord may be a woven, braided, or twisted collection of fibers that may be flexible and movable much like the transfer tape substrate. In other examples, a cord may be a single fiber element that has properties much like a woven, braided or twisted collection of fibers. In preferred embodiments, the cord or cord like elements may be formed of materials that are re-pulpable or that may dissolve upon a processing to repulp waste material including the transfer tapes. Cords may be formed of paper, paper fibers, or similar material. The incorporation of cords or cord like elements may impart a number of characteristics to the transfer tape including stiffening the tape, interconnecting the tape, and importantly it may give an attached transfer tape a profile thickened in the portion of the tape connected to the cord.

Figure 6:
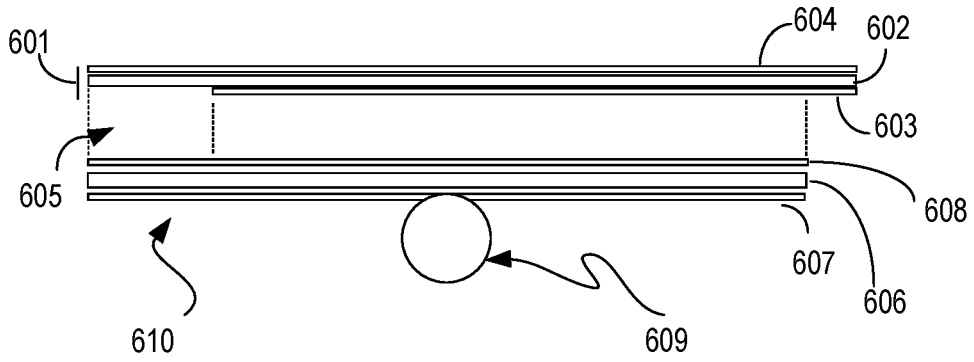
FIG. 6 illustrates an exploded end view of an embodiment of transfer tape with an incorporated cord.

Referring to FIG. 6, an exemplary transfer tape 610 with a cord element 609, a laminated composite 605 of a transfer tape base or substrate 606 and a zone-coated release liner member 601. The transfer tape substrate 606 may be composed of a paper stock member (or a member composed of similar, suitable material, most preferably re-pulpable) of sufficient strength, thickness, texture and stiffness to accomplish the turn-up transfer operation without breaking or separating throughout its subsequent use.

In some embodiments, a thin tissue like paper may be used as a substrate. Both sides of the transfer tape substrate 606 may be coated, layered or laminated with an adhesive, preferably a pressure sensitive adhesive 607, suitable for attaching one side (the mounting side) of the laminated transfer tape 610 to an empty paper web spool and the other side (the web side) to a paper web of tissue or the like. The pressure sensitive adhesive on the mounting side 607 may have different properties compared to the pressure sensitive adhesive on the web grabbing side 608. These different properties may include adhesion, tackiness, color, or thickness, among others. A cord 609 may be placed upon the pressure sensitive adhesive 607. In some embodiments, the cord 609 may be centered upon the transfer tape substrate 606. In other examples, it may be placed at a non-centered location.

In the embodiments illustrated in FIG. 6, the cord 609 may be adhered with the pressure sensitive adhesive 608 and the cord itself may not be coated with any adhesive (in other embodiments the cord may be partially or entirely coated with an adhesive). It may function to provide a spacing or surface topography/profile of the tape upon the empty web spool. The profile may create a pressure when the empty web spool interacts with a paper web. The pressure may aid in the efficacy of the adherence of the paper web to the Transfer Tape Construct and in the bursting of the paper web during turn-up. In addition, the elevated position of the points of adherence may enhance the forces that occur during the Turn-up which may enhance the forces that burst the paper web from attachment to the Parent Web Spool.

Figure 7:
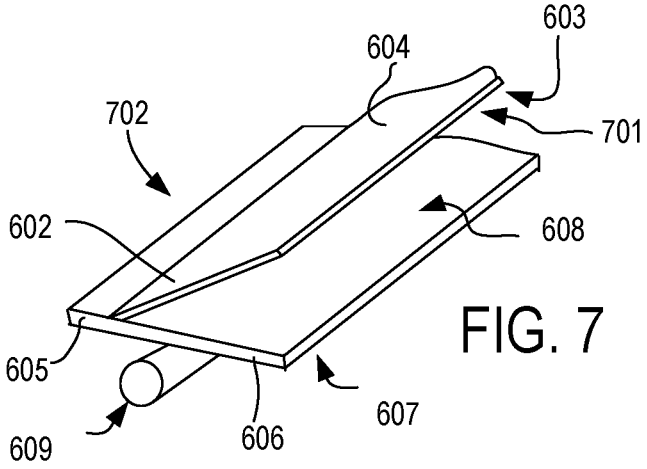
FIG. 7 illustrates a perspective illustration of the embodiment of FIG. 9 shown with the transfer tape assembled and with the cover flap partially open and with the incorporated cord thereunder.

Referring now to FIG. 7, release liner member 601 may include a release liner substrate 602, preferably composed of a re-pulpable material, that is fully coated on its exposed side with a release layer or coating 604 composed of a material, such as silicone, that has very low adhesion to the pressure sensitive adhesive. With this coating, the mounting side pressure sensitive adhesive 607 will not adhere to the release liner substrate 602 when the transfer tape 610 is wound onto the transfer tape spool of the dispenser cartridge, as the winding places the mounting side pressure sensitive adhesive 607 in contact with the release layer or coating 604. An opposite side (such as, for example, an interior side) of the release liner substrate 602 may be zone-coated with a suitably chosen release layer or coating 603 that prevents adhesion of the web grabbing pressure sensitive adhesive 608 to the release liner substrate 602. As previously mentioned, an underlying cord may raise portions of the web grabbing pressure sensitive adhesive 608 coated surface. The elements of the illustrated transfer tape 702 with attached cord 609 may be configured in the various manners as have been described herein.

Figure 8:
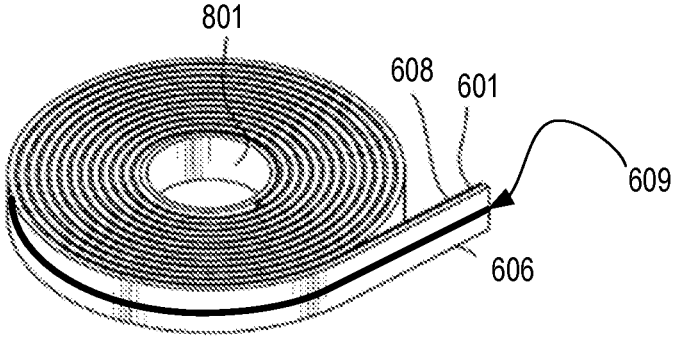
FIG. 8 illustrates a properly wound transfer tape having the tape substrate on the outside and the release liner on the inside to address buckling problems.
Figure 9:
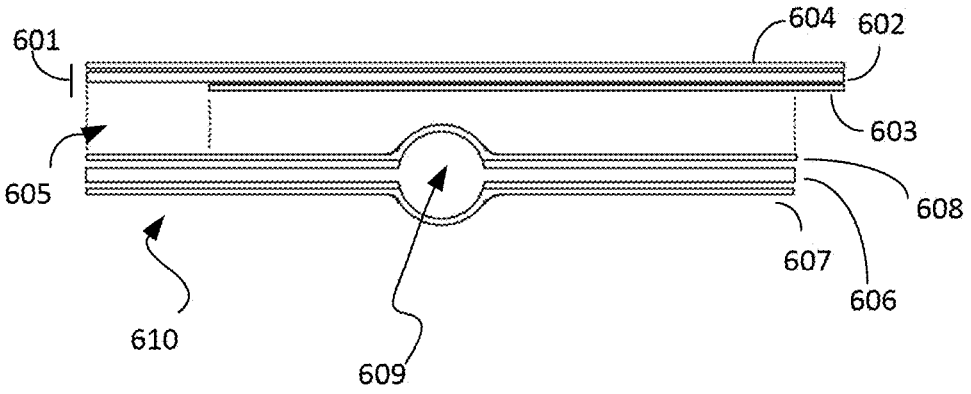
FIG. 9 illustrates an exploded end view of an alternative embodiment of transfer tape with an incorporated cord.

Referring now to FIG. 8, elements of the illustrated transfer tape 610 may be wound into a coil 801, having the tape substrate 606 on the outside and the release liner 601 on the inside to address buckling problems as previously discussed. The cord, attached to the tape substrate may, accordingly, be wound into the coil interacting with the release surfaces of the release liner member 601 of the underlying wound transfer tape. The transfer tape 610 may have a cord 609 or cord like feature incorporated in different manners.

Figure 10:
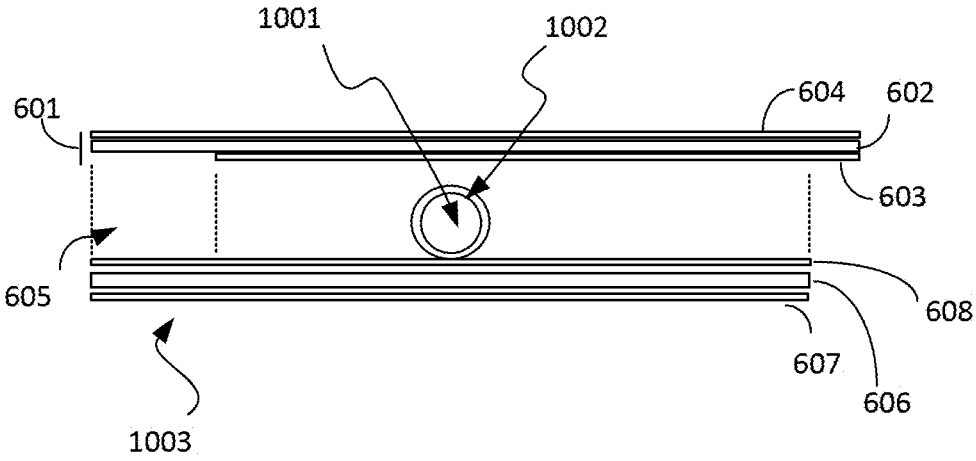
FIG. 10 illustrates an exploded end view of an alternative embodiment of transfer tape with an incorporated cord.

Referring now to FIG. 10, in some embodiments, the cord 1001 or cord like feature may be embedded or incorporated into the transfer tape substrate 606. For example, a paper cord, formed of braided and wrapped paper strands, may be pressed into a paper pulp during the formation of the paper transfer tape substrate 606. In other examples, the substrate may be formed of alternative materials where a protruding surface of the cord like element may be formed directly into the transfer tape substrate 606. As mentioned, the paper transfer tape substrate, in preferred examples, may be re-pulpable or it may be dissolvable when spare material waste, such as at the end of a spool, is recycled. In examples where the transfer tape substrate 606 is formed directly with a cord like feature, the shape may be different from the illustrated round feature, such as with a hemispherical shape protruding on one surface only. The cord 1001 or cord-like feature may be coated with pressure sensitive adhesive 1002.

Referring now to FIG. 10, a transfer tape 1003, may be assembled with a cord 1001 or cord like feature on the opposite side of the of the transfer tape substrate 606. If the cord 1001 is on the opposite side, it may face up towards a paper web during turn-up. Accordingly, in some embodiments, the cord 1001 or cord-like feature may be, itself, coated with pressure sensitive adhesive 1002. It may be the same pressure sensitive adhesive as the pressure sensitive adhesive 608 on the web grabbing pressure sensitive adhesive surface in some embodiments. The release liner member 601 may be dimensioned to accommodate the additional surface area due to the cord 1001, and in some embodiments, the release liner substrate 602 may have a bent shape when assembled into the transfer tape 1003.

Figure 11:
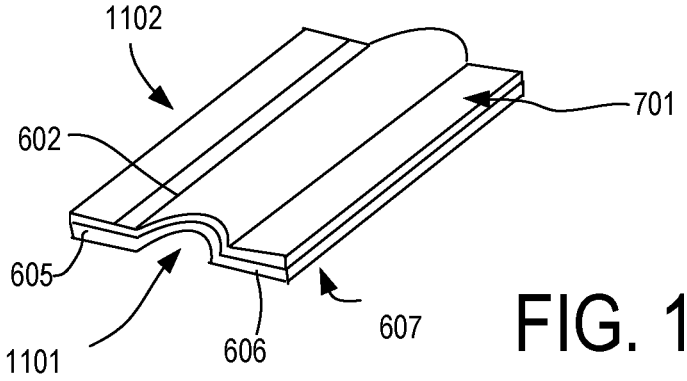
FIG. 11 illustrates a mounted cover flap transfer tape with a formed cavity structure.

Referring now to FIG. 11, a transfer tape 1102 may be assembled and attached in such a manner that a raised channel 1101 may be formed which may act in a similar manner as the cord features in previous discussion. The deformed region of the raised channel elevates the cover flap 701. In other ways the structure of the transfer tape 1102 may be as in other embodiments with a zone coated release liner substrate 602. There may be a longitudinally extending uncoated joining region to define the structure that fixedly holds the cover flap 701 when it opens. The lower structure may be formulated as has been discussed with a transfer tape substrate 606 with a layer of mounting side pressure sensitive adhesive, pressure sensitive adhesive 607 under the transfer tape substrate 606. As in other embodiments, the web grabbing pressure sensitive adhesive may be protected under the cover flap 701. The raised channel 1101 may have a number of effects including that it may present a larger aerodynamic interaction while a spool that the transfer tape construct is attached to is brought up to rotational speed. In addition, as the cover flap opens, the web grabbing pressure sensitive adhesive is slightly elevated which may enhance the interaction it has with the paper web and may increase aspects such as the pressure that occurs between the web grabbing pressure sensitive adhesive and the paper web.

Figure 12:
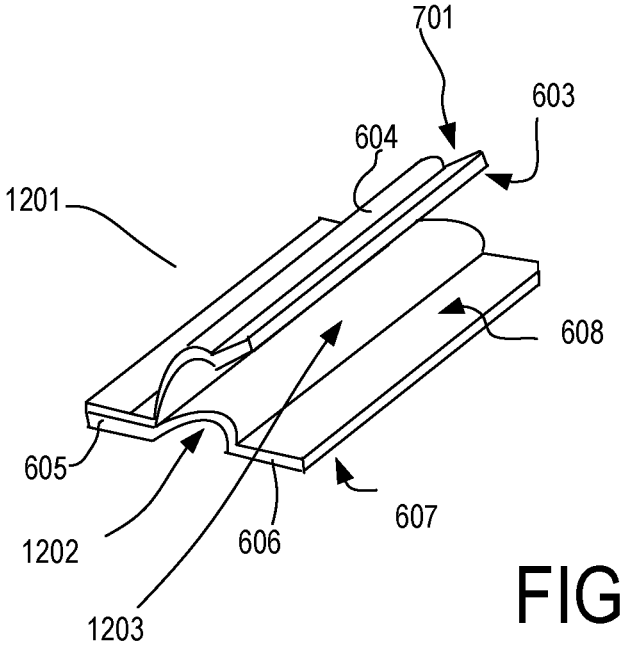
FIG. 12 illustrates a mounted cover flap transfer tape with a formed cavity structure with the cover flap opened.

Proceeding to FIG. 12, the raised channel construct of FIG. 11 is illustrated as the cover flap 701 opens in an open raised channel construct 1201. The open cover flap 701 exposes the web grabbing adhesive pressure sensitive adhesive 608. The raised channel 1202 elevates the web grabbing adhesive pressure sensitive adhesive 608 in its regions as shown at location 1203.

Figure 13:
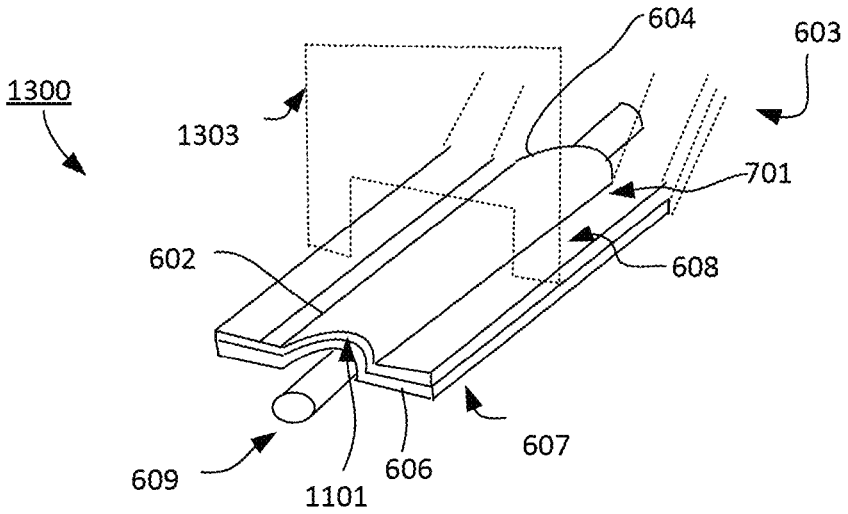
FIG. 13 illustrates an exemplary apparatus to mount the cover flap transfer tape with a formed cavity structure.

Proceeding to FIG. 13 an illustration of a manner of creating a raised profile transfer tape construct 1300 is illustrated. A portion of the transfer tape construct 1300 is illustrated as applied to a surface where a rod or cord 609 or similarly shaped protrusion may be pulled along the surface with the applicator. The presence of the rod 609 may shape the overlying transfer tape construct 1300 into a raised channel feature as has been described. The features in dotted lines are examples of features that may be present as the applicator applies the transfer tape 1300. These features may include portions of transfer tape substrate 606 as it is being applied to the surface as well as a wiper feature 1303 which may apply pressure to the surface on the edges of the transfer tape substrate 606 to affix the pressure sensitive tape to the surface beneath. Since the rod 609 or other similarly shaped element experiences a degree of pressure between it and the pressure sensitive adhesive of the transfer tape construct 1300 it may be useful to coat the transfer tape construct 1300 with non-stick surface treatments of various kinds including, in a non-limiting sense, a polytetrafluoroethylene (PTFE) coating.

Figure 14:
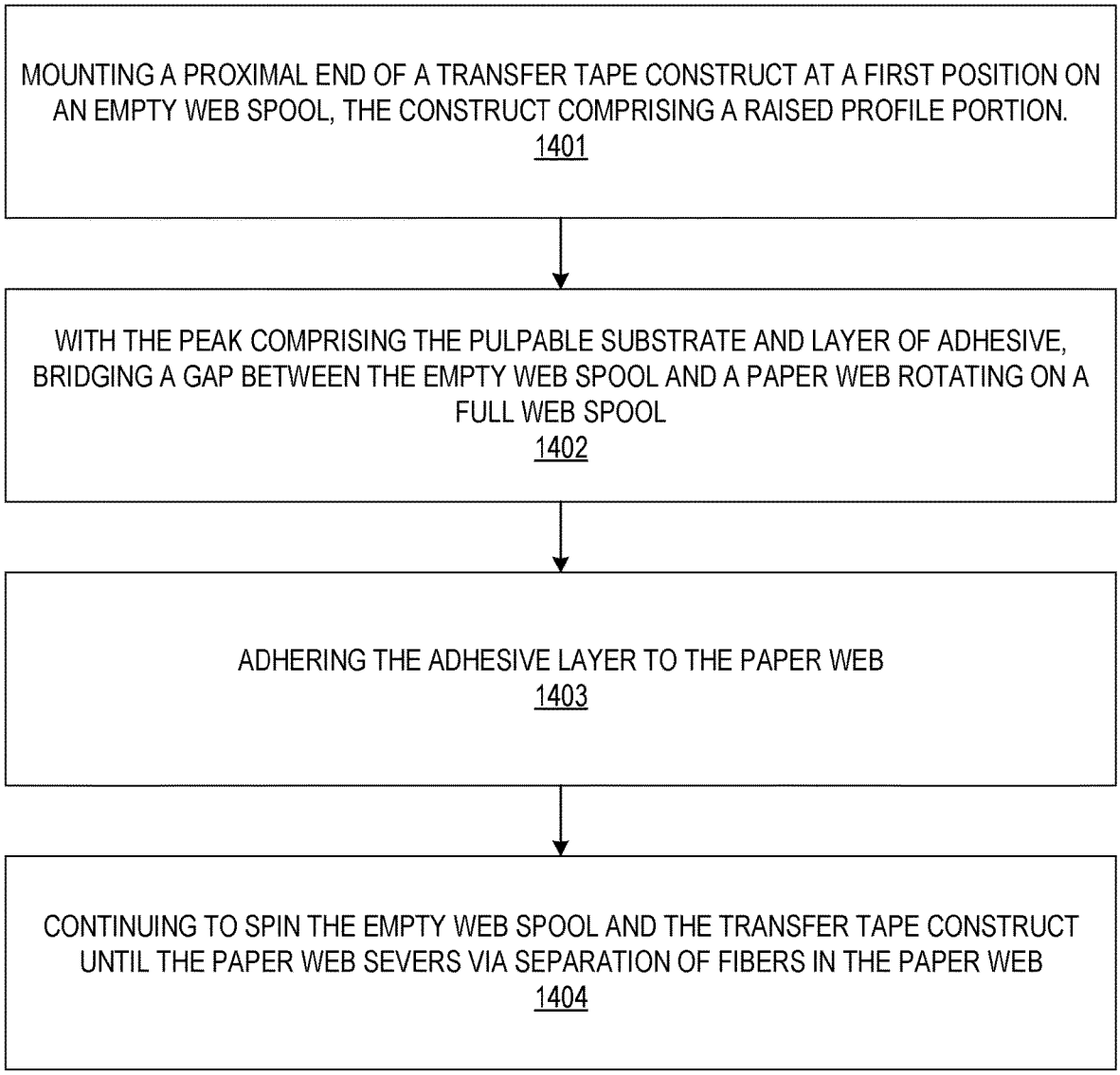
FIG. 14 illustrates exemplary method steps that may be performed in some implementations of the present invention.

Referring now to FIG. 14 a flowchart illustrates method steps that may be for performed according to some embodiments of the present disclosure.

At step 1401, the method may include mounting a proximal end of a transfer tape construct at a first position on an empty web spool, the transfer tape construct including layers of: adhesive, release coating, and pulpable substrate with a raised profile portion forming a peak with the pulpable substrate and layer of adhesive.

At 1402 the method may include, with the peak comprising the pulpable substrate and layer of adhesive, bridging a gap between the empty web spool and a surface of a paper web rotating on a full web spool.

At 1403 the method may include adhering the adhesive layer to the paper web, such that at 1404 the method may include continuing to spin the empty web spool and the transfer tape construct until the paper web severs via separation of fibers included in the paper web. The raised profile portion may include a combination of adhesive, release coating, and pulpable substrate to form a peak with the pulpable substrate and layer of adhesive, which may additionally be over a cord.

In some embodiments, the method may include continuing to spin, or otherwise rotating the empty web spool following the adhering of the adhesive layer to the paper web and severing of the paper web. The continued rotating of the empty web spool will cause a new roll of paper web to form on the once empty web spool.

In some embodiments, the method may include the step of protecting at least a portion of the adhesive layer from air borne contaminates with folded layers that may include one or more of: adhesive, release coatings and pulpable substrate. Air borne contaminants may include, for example, paper particles.

Particular embodiments of the subject matter have been described. Other embodiments are within the scope of the following claims. In some cases, the actions recited in the claims can be performed in a different order and still achieve desirable results. In addition, the processes depicted in the accompanying drawings do not necessarily require the particular order show, or sequential order, to achieve desirable results. In certain implementations, multitasking and parallel processing may be advantageous. Nevertheless, it will be understood that various modifications may be made without departing from the spirit and scope of the claimed invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the FIG.s.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

As has been mentioned, the illustrations depict aspects of exemplary embodiments, and the relative scale of illustrated features may be exaggerated for depiction of various aspects. Accordingly, the scale of features illustrated is not intended to limit the scope of the elements of the various embodiments consistent with the present application.

What is claimed is:

1. A method for performing a turn up process on a paper making machine, the turn up process comprising the steps of:

a. mounting a proximal end of a transfer tape construct at a first position on an empty web spool, the transfer tape construct comprising folded layers of: adhesive, release coating, and pulpable substrate, wherein the pulpable substrate comprises a raised profile portion forming a peak with the pulpable substrate and a layer of adhesive;

b. with the peak comprising the pulpable substrate and the layer of adhesive, bridging a gap between the empty web spool and a surface of a paper web rotating on a full web spool by lifting the raised profile portion of the transfer tape construct as a spool rotational speed of the empty web spool increases a centrifugal force on the raised profile portion of the transfer tape construct mounted on the empty web spool;

c. adhering the layer of adhesive to the paper web; and d. continuing to spin the empty web spool and the transfer tape construct until the paper web severs via separation of fibers included in the paper web.

2. The method of claim 1, additionally comprising the step of continuing to spin the empty web spool and the transfer tape construct following the adhering of the layer of adhesive to the paper web and the paper web severs, to form a roll of paper web on the empty web spool.

3. The method of claim 2, additionally comprising the step of attaching a distal end of the transfer tape construct at a second position on the empty web spool.

4. The method of claim 3 additionally comprising the step of protecting at least a portion of the layer of adhesive from air-borne contaminants with the folded layers of: adhesive, release coatings and pulpable substrate.

5. The method of claim 4, wherein the air-borne contaminants comprise paper particles.

6. The method of claim 3, additionally comprising the step of forming the peak comprising the pulpable substrate and the layer of adhesive by including a cord beneath the layer of adhesive and the raised profile portion.

7. The method of claim 6, additionally comprising the step of contacting the paper web with the peak of the raised profile portion comprising the pulpable substrate and the layer of adhesive formed over the cord.

8. The method of claim 7, additionally comprising the step of compressing the peak comprising the pulpable substrate and the layer of adhesive as the empty web spool approaches the paper web.

9. The method of claim 8, additionally comprising the step of crushing the cord.

10. The method of claim 9, wherein the cord comprises of one or more materials suitable to be re-pulped and included in a paper product.

11. The method of claim 10, wherein the cord consists of the one or more materials, each material suitable to be re-pulped and to be dissolved upon a processing, to repulp waste material.

12. The method of claim 10, additionally comprising the step of adhering the cord to the layer of adhesive.

13. The method of claim 12, wherein the layer of adhesive comprises a pressure sensitive coating.

14. The method of claim 10, wherein the transfer tape construct may be wound into a coil, which comprises the cord centered upon the transfer tape construct.

15. The method of claim 14, wherein the transfer tape construct comprises the raised profile portion to create a pressure when the empty web spool interacts with the paper web to aid in adherence of the paper web to the transfer tape construct.

16. The method of claim 15, wherein the raised profile portion creates the pressure when the empty web spool interacts with the paper web to aid in bursting of the paper web from attachment to the full web spool during the turn-up process.

17. The method of claim 8, additionally comprising the step of: following the step of compressing the peak comprising the pulpable substrate and the layer of adhesive, contacting and bonding additional surface area of the layer of adhesive with the paper web.

18. The method of claim 17, additionally comprising the step of winding the paper web onto the empty web spool.

19. The method of claim 1, wherein a release coating layer comprises a portion of a surface treated with a reduced adhesion strength substance.

20. The method of claim 19, wherein the reduced adhesion strength substance comprises a silicon based formulation.

* * * * *